United States Patent [19]

Flaum et al.

[11] 4,112,556

[45] Sep. 12, 1978

[54] ZIPPER CONSTRUCTION

[76] Inventors: Dennis Michael Flaum, 1 E. Schiller, Chicago, Ill. 60610; Herman Lawrence Fleishman, 6518 N. Kenton, Lincolnwood, Ill. 60645

[21] Appl. No.: 833,003

[22] Filed: Sep. 14, 1977

[51] Int. Cl.[2] ..... A44B 19/34; A44B 19/00

[52] U.S. Cl. ..... 24/205.1 R; 24/205 R; 150/3; 190/41 Z; 5/339; 2/265

[58] Field of Search ..... 24/205 R, 205.1 R; 2/234, 265, 96, 2.1 A; 190/41 C, 41 Z; 150/3; 5/339

[56] References Cited

U.S. PATENT DOCUMENTS

| | | | |
|---|---|---|---|
| 2,210,547 | 8/1940 | Hoffman | 24/205 R |
| 2,229,216 | 1/1941 | Marinsky | 24/205 R |
| 2,442,044 | 5/1948 | Howard | 24/205.1 R |
| 2,615,224 | 10/1952 | Shur | 24/205.1 R |
| 2,697,227 | 12/1954 | Prupis | 24/205 R |
| 3,448,463 | 6/1969 | Milone | 24/205 R |

FOREIGN PATENT DOCUMENTS

| | | | |
|---|---|---|---|
| 1,142,712 | 9/1957 | France | 24/205 R |

*Primary Examiner*—Bernard A. Gelak
*Attorney, Agent, or Firm*—Alter and Weiss

[57] ABSTRACT

A dual zipper construction provides a double closure to discourage opening of the zippered enclosure. The zippers co-extend, one above the other, with the upper zipper closing in a direction opposite that of the lower zipper. Each zipper has its engaging surface mounted on a pair of flaps, with one flap being longer than the other. When assembled, the longer flap on the upper zipper overlies the shorter flap on the lower zipper thus offsetting the opening and closing tabs of the two zippers; facilitating closure.

4 Claims, 5 Drawing Figures

ZIPPER CONSTRUCTION

BACKGROUND OF THE INVENTION

This invention relates to closure devices and more particularly, to a dual zipper-type closure intended to provide a more secure closing.

Zipper and zipper-type fasteners provide conveniently operable closures particularly where articles of furniture are concerned. Most commonly, zippers are utilized to maintain an outer covering or fabric about such articles as sofa cushions. In this manner, the cushion is covered and used, and the cover may be removed for cleaning or for purposes of redecorating or reupholstering. Similarly, the main frame of the sofa may also be covered by fabric secured by zippers, thus allowing removal of the sofa cover as well as the cushion cover.

In some instances, however, it is necessary to provide zippered access to an article during, for example, an initial construction phase, yet discourage such access thereafter. Problems such as these are encountered in the manufacture construction and use of bean bag type furniture articles. Typically, the bag itself is formed from individual panels which are seamed together to form a hollow body. Stuffing, comprising expanded polyfoam "beans" is then used to fill the bean bag through a partial opening somewhere on the bag surface. Most typically, such openings are secured by zippers.

The plastic beans provide a unique degree of support allowing the bean bag to deform to the contours of the person seated thereon. Characteristically, such bean bags may be "plumped" after use to maintain their original configuration. Use of such furniture by children is common and it is desirable that a child's curiosity should not easily lead to the opening of the zippered closure with the consequent emptying of the polyfoam beans from the interior of the bean bag.

One solution to such a problem would be to seam the opening shut after the bag has been filled. This would require a further seaming operation after filling and may result in an unsightly seam particularly compared to the remaining seams on the bag. In any event, permanent closure of the bag would preclude access required to add or change the filling of the bag as may be desired or necessary after the bag has been used for a length of time.

One attempted solution has been to make the closure more difficult to open, particularly for the hands of a child. Accordingly, the present invention has the following objects:

To provide zippered closures for furniture articles which are typically more difficult to open than close;

To provide such closures informs utilizing a pair of conventionally operating zippers;

To provide such closures in forms whereby a plurality of such zippers are positioned one above the other;

To provide such closures in forms whereby the zipper constructions so oriented are offset slightly one from the other to facilitate closure;

To provide such closures in forms readily openable upon application of strength, dexterity and persistance typically beyond that of a young child; and To provide such construction in forms simple and economical to manufacture and install.

These and further objects will become more apparent upon consideration of the accompanying drawings, in which.

Figure 1:
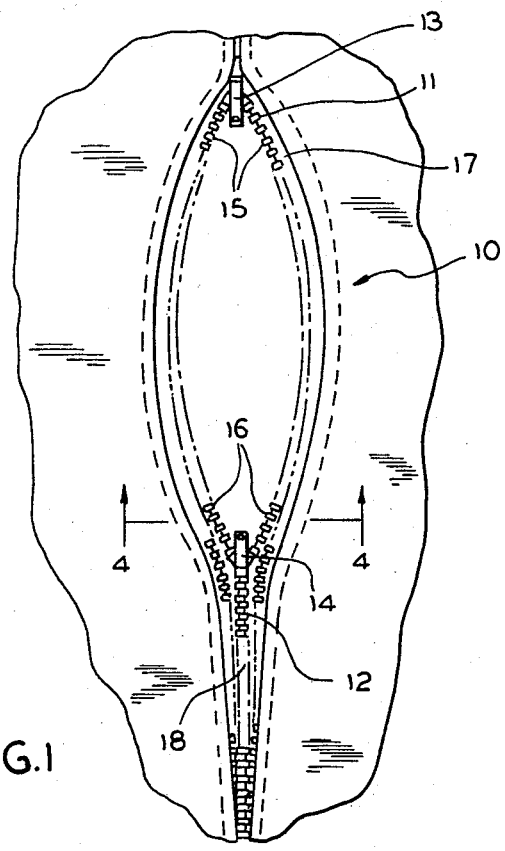
FIG. 1 is a partial top view of the closure illustrating the lowermost slide fastener in a partially closed position and the uppermost slide fastener in a full open position.

Consistent with the foregoing objectives, Applicant provides dual closure 10 with upper slide fastener 11 and lower slide fastener 12; each slide fastener, 11 and 12, has a series of interconnectable elements 15 and 16 which are spaced apart and mounted on ribbon segments 17 and 18. Each series of interconnectable elements, 15 and 16, are interconnected or de-interconnected by sliders 13 and 14, respectively.

Each ribbon segment, 17 and 18, comprises unequally sized segments **17*a*, 17*b*, 18*a*, 18*b* which can be sewn together and inserted into opening 23 of bean bag 24 and sewn to bottom panel 25 of bean bag 24. This allows selective access to the cavity within bean bag 24**.

Referring now to FIG. 1, the numeral 10 indicates generally a dual closure having upper slide fastener 11 and lower slide fastener 12. Each such slide fastener includes a slider 13 and 14 respectively and a series of interconnectable elements 15 and 16 respectively spaced apart and mounted on ribbon segments 17 and 18 respectively.

Figure 4:
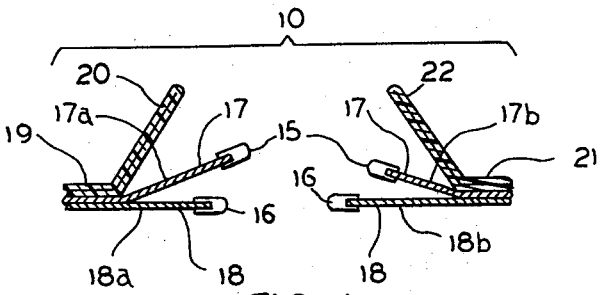
FIG. 4 is a view along 4—4 of FIG. 1.
Figure 3:
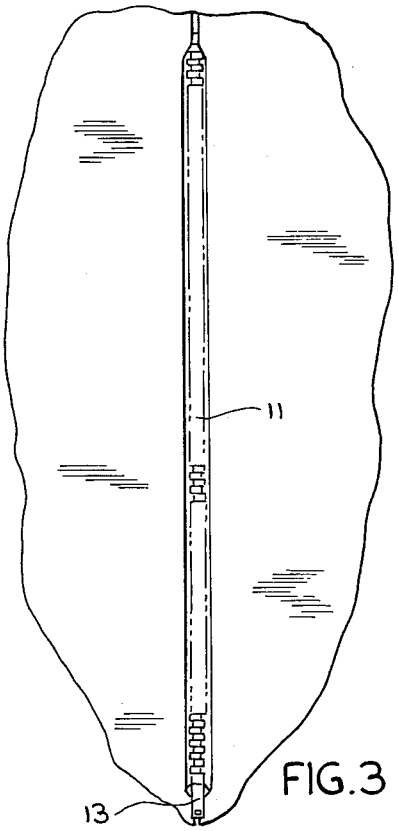
FIG. 3 is a partial top view of the closure in a fully closed position.
Figure 5:
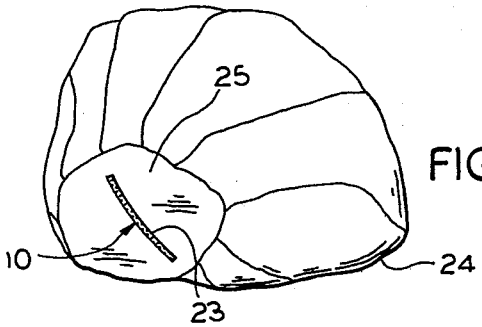
FIG. 5 is a partial perspective view of a piece of bean bag furniture illustrating use of the closure.

As best illustrated in FIG. 4, each ribbon 17 and 18 respectively includes unequally sized segments **17*a*, 17*b*, 18*a* and 18*b* respectively. In the embodiment discussed herein, segment 17*a* overlaps segment 18*a*, while segment 18*b* overlaps segment 17*b*. When interconnectable elements 15 and 16 are fully inteconnected, the tracks so formed, while positioning one above the other, will be slightly offset. This offset enables slider 13 to be moved along interconnectable elements 15 and to pass over slider 14** without being fouled.

Ribbons **17*a* and 18*a* are stitched together at 19, together with flap 20 which covers half of the closure. Similarly, flaps 17*b* and 18*b* are seamed together at 21 together with flap 22** which covers the remaining portion of the closure.

Final assembly and use of the closure may be described as follows:

As described hereinabove, ribbon **17*a* and 17*b* of upper slide fastener 11 are seamed to ribbons 18*a* and 18*b* respectively of lower slide fastener 12. As best seen in the embodiment illustrated at FIG. 4, ribbons 17 and 18 are staggered such that ribbon segment 17*a* overlaps segment 18*a*, and segment 18*b* overlaps segment 17*b***.

The completed slide fastener construction 10 is then seamed to opening 23 formed on bottom panel 25 of bean bag 24 at 19 and 21, a short distance away from opening 23, thereby forming flaps 20 and 22. Attachment of zipper construction 10 to bean bag 24 is preferably accomplished prior to the attachment of bean bag bottom panel 25, thus allowing closure 10 to be positioned and stitched with a medium of inconvenience.

Figure 2:
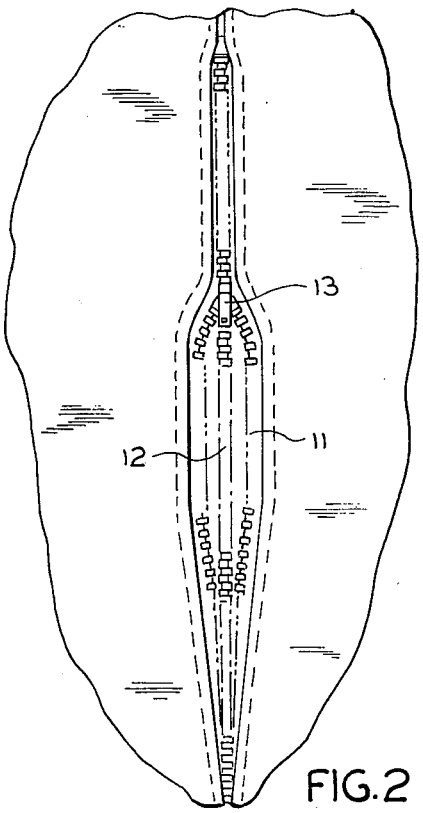
FIG. 2 illustrates the closure of FIG. 1 with the lowermost slide fastener fully closed and the uppermost slide fastener partially closed.

After bottom panel 25 has been seamed to bag 24, the bag is ready to be filled with polystyrene beans. When the bag has been sufficiently filled, slider 14 of lower slide fastener 12 is moved to engage interconnectable elements 18 to maintain slide fastener 12 in a closed attitude, as seen in FIGS. 1 and 2. During construction, slide fasteners 11 and 12 are positioned such that movement of slider 14 to close slide fastener 12 is in a direction opposite that required for slider 13 to close slide fastener 11. In this manner, when slide fastener 11 is in its fully closed attitude, slider 14 will be overlapped and thus inacessible until slide fastener 11 is fully opened. Access to the interior of bean bag 24 may thus be had only after upper slide fastener 11 is fully opened to reveal slider 14, enabling lower slide fastener 12 to be opened. Were the slide fastened to be oriented such that closure of both was accomplished in the same direction, a relatively small opening in upper slide fastener 11 would enable access to slider 14 and eventual access to the interior of bean bag 24.

While the foregoing preferred embodiment has described a closure construction utilizing a pair of slide fasteners, it should be readily apparent that any number of such slide fasteners may be utilized to achieve a required degree of security. Each slide fastener should be oriented to open in a direction directly opposite that of those slide fasteners immediately adjacent to it. Selective access to the interior of bean bag 24 is thus provided for the strong, dexterous band of the adult; at the same time such access is denied to a child, thus insuring that the stuffing of the bean bag will remain with the bag rather than being scattered about during a child's normal play activities.

While the foregoing has presented a preferred embodiment of the invention, it is to be understood that this embodiment is presented by way of example only. It is expected that others skilled in the art will perceive differences which, while differing from the foregoing, do not depart from the spirit and scope of the invention as described and claimed.

What is claimed is:

1. A closure fashioned from slide fasteners, each of said slide fasteners including two ribbons, each said ribbon having thereon a series of interconnectable elements alternatingly positioned and spaced apart, and a slider which is moved along said two ribbons in a first direction to open or in a second direction to close said fasteners by deinterconnecting or interconnecting said two series of interconnectable elements, said closure comprising:

a plurality of said slide fasteners arranged to abut one another in parallel stacked alignment, each said slide fastener oriented to open in a direction opposite that of its immediately suprajacent or subjacent partner, said ribbons of each said slide fastener being attached directly to the corresponding of said ribbons on said immediately said subjacent or suprajacent partner.

2. The invention according to claim 1, wherein:

said interconnectable elements of each slide fastener are laterally offset from the interconnectable elements of slide fasteners suprajacent or subjacent thereto, whereby the movement of the respective sliders of said slide fasteners is facilitated.

3. A closure fashioned from a pair of slide fasteners, each of said slide fasteners having two ribbons, each said ribbon having a series of interconnectable elements thereon which are alternatingly positioned and spaced apart, and a slider which is moved along said two ribbons selectively in a first direction to open and in a second direction to close said fasteners by interconnecting or deinterconnecting said two series of interconnectable elements, said closure comprising:

said pair of slide fasteners, arranged in parallel stacked alignment, each one of said ribbons of the first of said slide fasteners fastened directly to a corresponding ribbon of the second of said slide fasteners, the first of said pair of said slide fasteners oriented to open in a direction opposite that of the second of said pair of said slide fasteners.

4. The invention according to claim 3, in which:

said interconnectable elements of said first slide fastener are laterally offset from said interconnectable elements of said second slide fastener, thereby facilitating the movement of the respective sliders of each said slide fastener.

* * * * *

UNITED STATES PATENT AND TRADEMARK OFFICE

CERTIFICATE OF CORRECTION

PATENT NO. : 4,112,556

DATED : September 12, 1978

INVENTOR(S) : Dennis Michael Flaum & Herman Lawrence Fleishman

It is certified that error appears in the above-identified patent and that said Letters Patent are hereby corrected as shown below:

| | |
|---|---|
| Col. 3, Line 24 | Change "band" should be --hand--. |
| Col. 4, Line 15 | Change "the interconnectable" should be --said interconnectable--. |

Signed and Sealed this

Sixth Day of February 1979

[SEAL]

*Attest:*

RUTH C. MASON
*Attesting Officer*

DONALD W. BANNER
*Commissioner of Patents and Trademarks*